US006616138B2

(12) United States Patent
Tanaka

(10) Patent No.: US 6,616,138 B2
(45) Date of Patent: Sep. 9, 2003

(54) RECORDING DEVICE AND A DEVICE FOR SEPARATING AND FEEDING PAPER

(75) Inventor: Hironori Tanaka, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/941,730

(22) Filed: Aug. 30, 2001

(65) Prior Publication Data

US 2002/0060396 A1 May 23, 2002

(30) Foreign Application Priority Data

Sep. 1, 2000 (JP) ..... P2000-265547

(51) Int. Cl.[7] ..... B65H 3/52

(52) U.S. Cl. ..... 271/124; 271/121; 271/113; 271/160

(58) Field of Search ..... 271/109, 113, 271/121, 124, 149, 160

(56) References Cited

U.S. PATENT DOCUMENTS

| | | | | | |
|---|---|---|---|---|---|
| 3,958,800 | A | * | 5/1976 | Gates | 271/126 |
| 5,154,408 | A | * | 10/1992 | Stepan et al. | 271/121 |
| 5,528,352 | A | * | 6/1996 | Ichinokawa et al. | 355/308 |
| 5,584,475 | A | * | 12/1996 | Asada et al. | 271/121 |
| 5,890,707 | A | * | 4/1999 | Allibert et al. | 271/9.09 |
| 5,895,040 | A | | 4/1999 | Oleksa et al. | |
| 5,918,873 | A | * | 7/1999 | Saito et al. | 271/10.11 |
| 6,283,468 | B1 | * | 9/2001 | Sugiura | 271/119 |
| 6,305,682 | B1 | * | 10/2001 | Saito et al. | 271/10.11 |
| 6,308,947 | B1 | * | 10/2001 | Kojima et al. | 271/124 |
| 6,331,002 | B1 | * | 12/2001 | Yoshino et al. | 271/117 |
| 6,371,477 | B1 | * | 4/2002 | Lin | 271/121 |
| 6,378,858 | B1 | * | 4/2002 | Suga | 271/10.01 |
| 6,536,757 | B2 | * | 3/2003 | Chang | 271/16 |
| 6,540,221 | B2 | * | 4/2003 | Nakashima et al. | 271/121 |
| 2002/0070495 | A1 | * | 6/2002 | Takeuchi | 271/121 |
| 2003/0038419 | A1 | * | 2/2003 | Kawai et al. | 271/18 |
| 2003/0062668 | A1 | * | 4/2003 | Shibata et al. | 271/121 |

FOREIGN PATENT DOCUMENTS

| | | | | |
|---|---|---|---|---|
| JP | 2-163239 | * | 6/1990 | 271/121 |
| JP | 2-282124 | * | 11/1990 | 271/121 |
| JP | 4-116030 | * | 4/1992 | 271/121 |
| JP | 5-43074 | | 2/1993 | |
| JP | 5-201556 | * | 8/1993 | 271/121 |
| JP | 6-144618 | * | 5/1994 | 271/121 |
| JP | 8-259020 | | 10/1996 | |
| JP | 9-2670 | | 1/1997 | |
| JP | 9-12168 | | 1/1997 | |
| JP | 11-11719 | | 1/1999 | |
| JP | 11-35165 | | 2/1999 | |

* cited by examiner

*Primary Examiner*—Donald P. Walsh
*Assistant Examiner*—Daniel K Schlak
(74) *Attorney, Agent, or Firm*—Birch, Stewart, Kolasch & Birch, LLP

(57) ABSTRACT

Resilient supporting member for resiliently supporting the lower edge of recording paper sheets is provided near a lower part of a back plate of a paper sheet feeding apparatus. The resilient supporting member includes a rocking support piece and a spring. When the recording paper sheets are inserted into the paper sheet feeding apparatus, the rocking support piece is angularly displaced about an axis extending perpendicularly to the paper sheet feeding direction and absorbs the impact force generated in inserting the recording paper sheets, whereby the rocking support piece is pressed against a predetermined holding portion by an upwardly directed spring force and the angle that the receiving face of the rocking support piece makes with the supporting face of the back plate is held at an angle θ1 suitable for paper sheet feeding.

8 Claims, 9 Drawing Sheets

RECORDING DEVICE AND A DEVICE FOR SEPARATING AND FEEDING PAPER

BACKGROUND OF THE INVENTION

1. Field of the Invention

The present invention relates to a paper sheet feeding apparatus for feeding a recording paper sheet, which may be incorporated in a recording apparatus used with a communication apparatus, information processing apparatus, and the like.

2. Description of the Related Art

Various methods for feeding paper sheets one by one have been used in paper sheet feeding apparatuses mounted in recording apparatuses for use with communication apparatuses, information processing apparatuses, and the like. In one method, the bottom plate of a cassette in which a stack of recording paper sheets is placed is pushed upward by a spring or the like, and both edges of the forward end of the recording paper sheets in the paper sheet feeding direction are pressed by pawls; in this condition, the recording paper sheets in the cassette are advanced in the paper sheet feeding direction by means of a paper sheet feeding roller, and the uppermost sheet of the recording paper sheets is fed out of the cassette when the advancing force of the uppermost paper sheet overcomes the pressing force being applied by the pawls. In another method, a recording paper sheet is fed to a position between a paper sheet feeding roller and a resisting member mounted in contacting relationship to the paper sheet feeding roller, the resisting member being made of rubber or other material having a large friction coefficient, and only the uppermost sheet contacting the paper sheet feeding roller rotating in the paper sheet feeding direction is fed out when the advancing force of the uppermost paper sheet overcomes the resisting force of the resisting member. In a further method, a roller rotating in the paper sheet feeding direction is disposed on the outer surface side of the paper sheet to be fed, and a roller rotating in the direction opposite to the paper sheet feeding direction is mounted on the bottom surface side of the stack of recording paper sheets held in the cassette, the roller rotating in the direction opposite to the paper sheet feeding direction thus acting to push back under recording paper sheets except the uppermost one, while allowing only the uppermost one of the paper sheets to be fed out. In a still further method, only the uppermost paper sheet to be fed is lifted by a vacuum, while holding back the under paper sheets by a vacuum force being applied by a vacuum device from the opposite side, thereby allowing only the uppermost recording paper sheet to be fed out.

Besides the above-described recording paper sheet feeding methods, there is also used an angular separation method in which recording paper sheets are separated and fed out by using a back plate having a supporting face for supporting the recording paper sheets thereon, in combination with a bottom plate mounted at a predetermined angle to the back plate on the downstream side thereof along the recording paper sheet feeding direction and used to separate the recording paper sheets. A paper sheet feeding apparatus using the angular separation method can accomplish the separation and feeding of recording paper sheets with a simple construction. Furthermore, since a recording paper sheet feeding apparatus using the angular separation method, despite its simple construction, can handle recording paper sheets with a variety of thicknesses and requires less mounting space, the installation space of a recording apparatus equipped with such a paper sheet feeding apparatus, and hence the floor space of a communication apparatus or information processing apparatus using the recording apparatus, can be reduced. Moreover, if the paper sheet feeding roller for feeding the recording paper sheet is formed, for example, in a semicircular shape, the paper sheet feeding roller does not contact and apply a load to the sheet being fed out once the sheet is separated and fed from the stack of recording paper sheets. This offers the advantage of being able to smoothly feed out the sheet for printing. These and other advantages have lead to the widespread use of the angular separation method.

While the angular separation method offers various advantages, it does not necessarily provide a perfect solution when it comes to reliably feeding recording paper sheets of a wide variety of thicknesses one by one. A prior art technique addressing this deficiency is disclosed, for example, in Japanese Unexamined Patent Publication JP-A 9-12168 (1997). In this prior art, an auxiliary separation plate formed from an elastic member is provided in addition to the fixed angle bottom plate (also called a separation plate in the prior art), and this auxiliary separation plate is constructed to contact the recording paper sheet at a more acute angle than the separation plate does. At the downstream side of the recording paper sheet as viewed in the recording paper sheet feeding direction, the auxiliary separation plate flexes so that its angle increases, which in turn reduces the recording paper sheet feeding resistance; on the other hand, at the upstream side as viewed in the recording paper sheet feeding direction, the auxiliary separation plate does not flex much, so that its angle remains small, providing large recording paper sheet feeding resistance. In this way, by utilizing the flexing action of the auxiliary separation plate, reliable recording paper sheet separation and recording paper sheet feeding operations can be performed on recording paper sheets of various thicknesses.

The above prior art has the following problem. When the user of the paper sheet feeding apparatus loads a stack of recording paper sheets into the paper sheet feeding apparatus, if the stack of recording paper sheets is inserted into the paper sheet feeding apparatus attended with an impact force, the recording paper sheet may cross the boundary between the back plate and the separation plate, and the lower edges of some of the inserted recording paper sheets may ride over the separation plate. With the lower edges of some of the recording paper sheets riding over the separation plate, if a recording paper sheet feed operation is started, more than one recording paper sheet will be fed out simultaneously, because the recording paper sheets already riding over the separation plate cannot be separated one by one by the separation plate.

The recording paper sheet separation and feeding method using the separation plate and auxiliary plate of the prior art ensures that recording paper sheets are fed out one by one even in the case of recording paper sheets with a wide variety of thicknesses, provided that the recording paper sheets are loaded properly into the paper sheet feeding apparatus; however, when the user has loaded the recording paper sheets into the paper sheet feeding apparatus in such a manner as to cause the lower edges of some of the sheets to ride over the separation plate, the recording paper sheets cannot be properly separated and fed out one by one.

SUMMARY OF THE INVENTION

It is an object of the invention to provide a paper sheet feeding apparatus capable of reliably separating and feeding out recording paper sheets one by one immediately after the recording paper sheets are loaded, even when the recording paper sheets are inserted into the paper sheet feeding apparatus attended with an impact force. It is another object of the invention to provide a recording apparatus equipped with such a paper sheet feeding apparatus.

The invention provides a paper sheet feeding apparatus comprising:

a back plate having a supporting face, arranged so as to slope down toward a downstream side in a paper sheet feeding direction;

resilient supporting means, disposed near a lower part of the back plate, for resiliently supporting a lower edge of a stack of recording paper sheets resting on the back plate;

a bottom plate, disposed downstream of the resilient supporting means in the paper sheet feeding direction, for guiding the recording paper sheets; and a paper sheet feeding roller for feeding out an uppermost sheet of the stack of recording paper sheets by contacting an uppermost recording paper sheet of the stack of recording paper sheets held on the supporting face.

According to the invention, since the resilient supporting means for resiliently supporting the lower edge of the stack of recording paper sheets resting on the back plate is provided near the lower part of the back plate, if the user inserts the recording paper sheets into the paper sheet feeding apparatus attended with an impact force, the resilient supporting means can absorb the impact force applied when inserting the recording paper sheets. Accordingly, since the impact force generated in inserting the recording paper sheets into the paper sheet feeding apparatus is alleviated by the provision of the resilient supporting means, the recording paper sheets can be prevented from riding over the bottom plate, thus avoiding a situation where a plurality of sheets are fed out simultaneously.

In the invention, it is preferable that the resilient supporting means includes:

a rocking support piece whose downstream end portion in the paper sheet feeding direction is supported so as to be angularly displaceable about an axis extending perpendicularly to the paper sheet feeding direction, and whose upstream end portion as viewed in the paper sheet feeding direction is positioned rearwardly of the supporting face of the back plate, and a spring for applying an upwardly directed spring force to the upstream end portion of the rocking support piece, and thereby pressing the upstream end portion of the rocking support piece against a predetermined position with a stack of recording paper sheets held in a stationary condition, and the following relation is satisfied:

$$\theta 1 > \theta 2,$$

wherein $\theta 1$ represents an angle which a receiving face of the rocking support piece makes with the supporting face of the back plate when the stack of recording paper sheets is held in the stationary condition, and $\theta 2$ represents an angle which the supporting face of the back plate makes with a guide face of the bottom plate.

According to the invention, since the resilient supporting means includes the spring and the angularly displaceable rocking support piece, when the recording paper sheets are inserted into the paper sheet feeding apparatus attended with an impact force, the rocking support piece is displaced angularly to absorb the impact force, and when the impact force is released, the rocking support piece is restored to the predetermined position where the angle that the receiving face of the rocking support piece makes with the supporting face of the back plate when the stack of recording paper sheets is held in the stationary condition is held at $\theta 1$. Accordingly, when the recording paper sheets are inserted into the paper sheet feeding apparatus, the recording paper sheets are prevented from riding over the receiving face of the rocking support piece by the impact force generated at the time of insertion, and further, since, when the recording paper sheet separation and feed operation is started, the angle that the receiving face of the rocking support piece makes with the supporting face of the back plate is held at the predetermined suitable angle $\theta 1$, the recording paper sheet can be reliably separated and fed out one sheet at a time. Furthermore, since the angle $\theta 1$ that the receiving face of the rocking support piece makes with the supporting face of the back plate is greater than the angle $\theta 2$ that the supporting face of the back plate makes with the guide face of the bottom plate, the recording paper sheets separated for feeding are fed out smoothly without a hitch along the guide face of the bottom plate.

In the invention, it is preferable that a plurality of rocking support pieces are disposed spaced apart in a direction perpendicular to the paper sheet feeding direction.

According to the invention, the number of rocking support pieces that support the lower edge of the recording paper sheets differs according to the size of the recording paper sheets to be fed. This means that the force resistant to the feeding of the recording paper sheets, which is generated by the contact of the receiving faces of the rocking support pieces with the lower edge of the recording paper sheets, is adjusted according to the number of rocking support pieces that support the lower edge of the recording paper sheets. Accordingly rocking support pieces whose number is appropriate to the size of the recording paper sheets contacts the lower edge of the recording paper sheets with the result that the separation and feed of the recording paper sheets is smoothly carried out.

In the invention, it is preferable that a serrated portion with serrations arranged in the paper sheet feeding direction is formed on the receiving face of the rocking support piece.

According to the invention, since the serrated portion with serrations arranged in the paper sheet feeding direction is formed on the receiving face of the rocking support piece, even when the recording paper sheets are inserted into the paper sheet feeding apparatus attended with an impact force, the serrated portion securely supports the lower edge of the inserted paper sheets with the serrations acting to prevent the recording paper sheets from slipping and riding over the receiving face of the rocking support piece. This structure further enhances the function of reliably feeding the recording paper sheets one by one even when the recording paper sheets are inserted into the paper sheet feeding apparatus attended with an impact force.

The invention also provides a recording apparatus comprising:

one of the paper sheet feeding apparatuses described above; and a print head for printing on a recording paper sheet at a position downstream of the bottom plate of the paper sheet feeding apparatus as viewed in the paper sheet feeding direction.

According to the invention, since the recording apparatus is equipped with the paper sheet feeding apparatus that can reliably feed the recording paper sheet one by one, wastage of recording paper sheets is avoided when printing on a recording paper sheet by keeping a plurality of recording paper sheets from being fed simultaneously.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
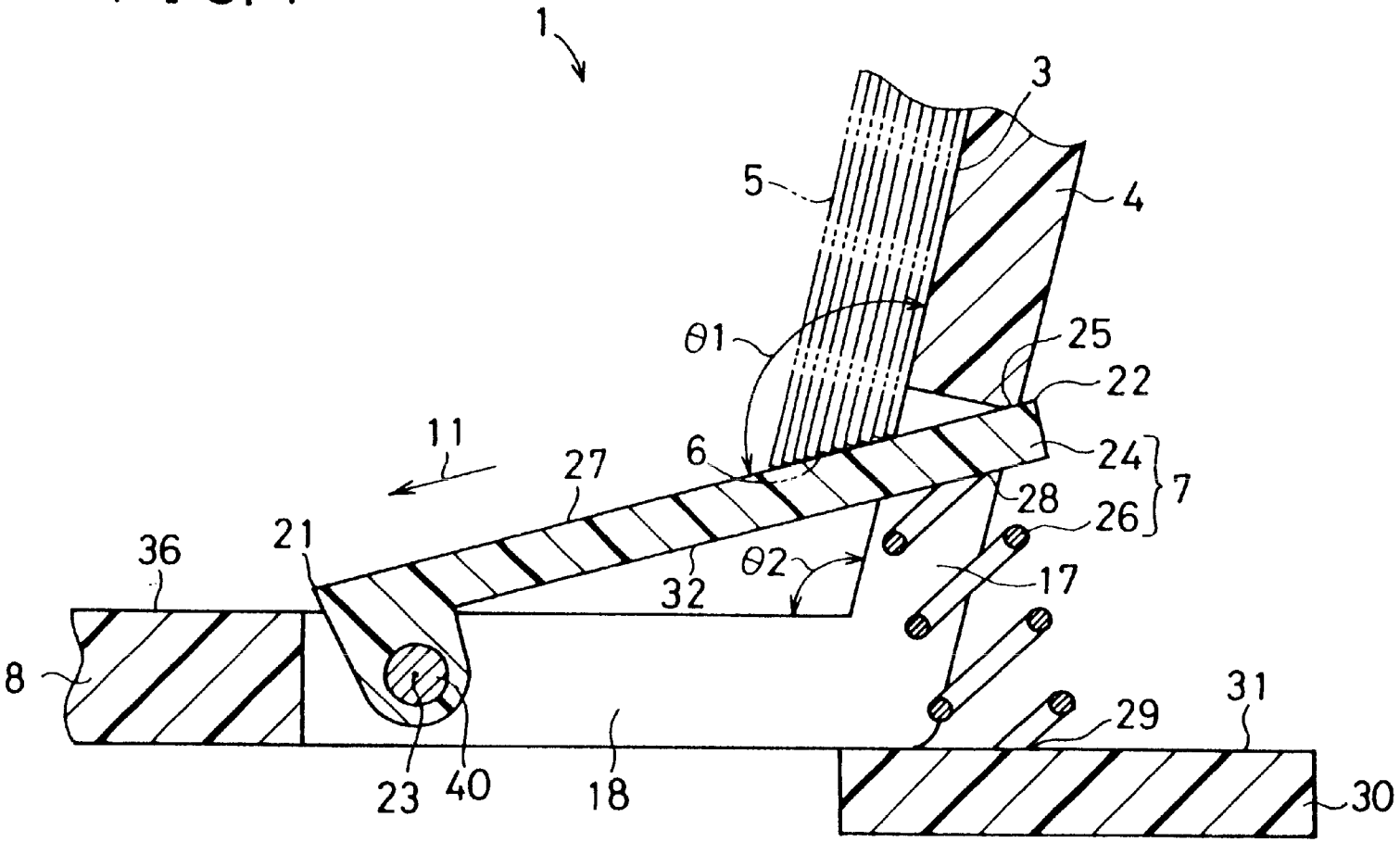
FIG. 1 is a cross sectional view showing in simplified form the construction of a paper sheet feeding apparatus 1 according to one embodiment of the invention.

Now referring to the drawings, preferred embodiments of the invention are described below.

Figure 2:
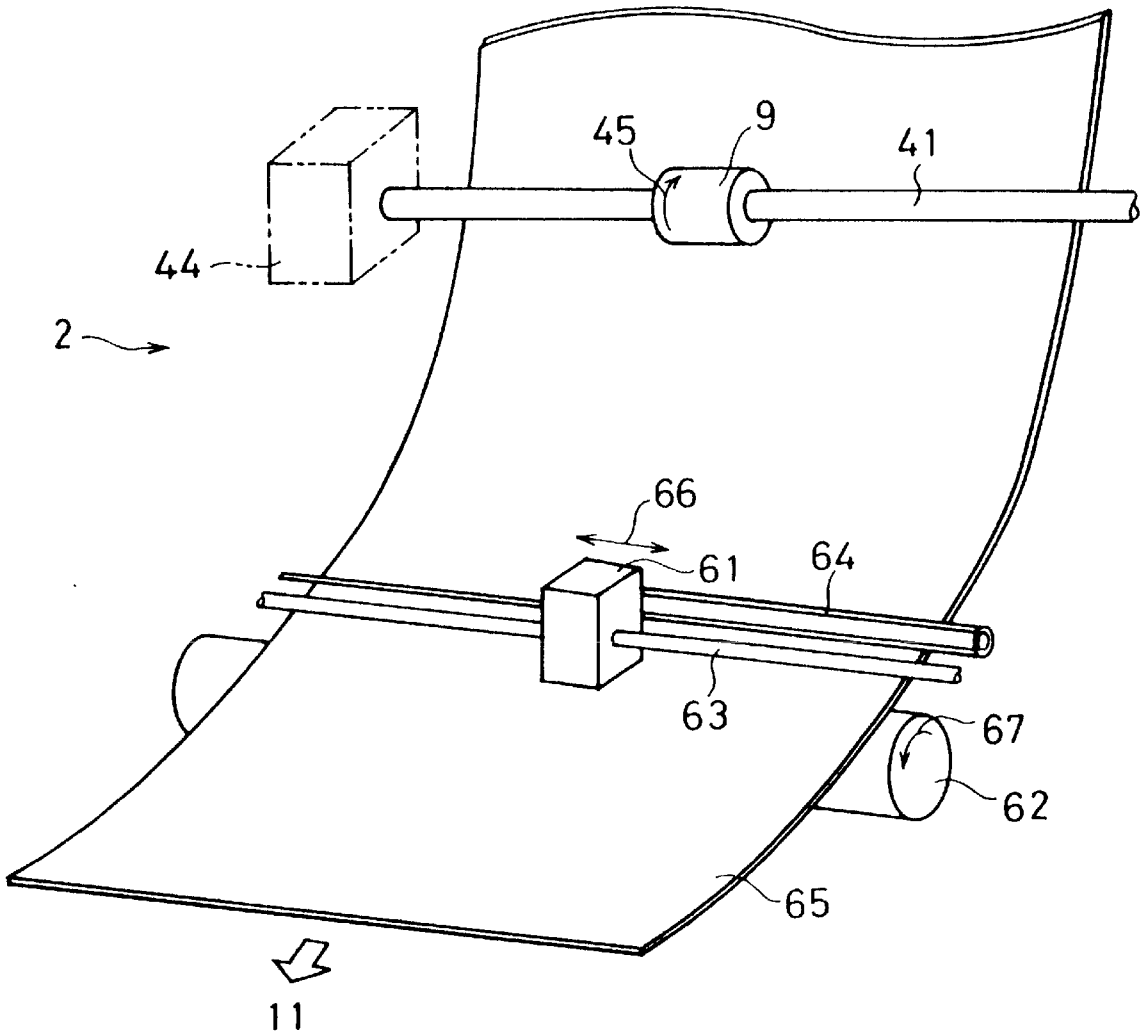
FIG. 2 is a perspective view showing in simplified form the construction of a recording apparatus 2 equipped with the paper sheet feeding apparatus 1 shown in FIG. 1.
Figure 3:
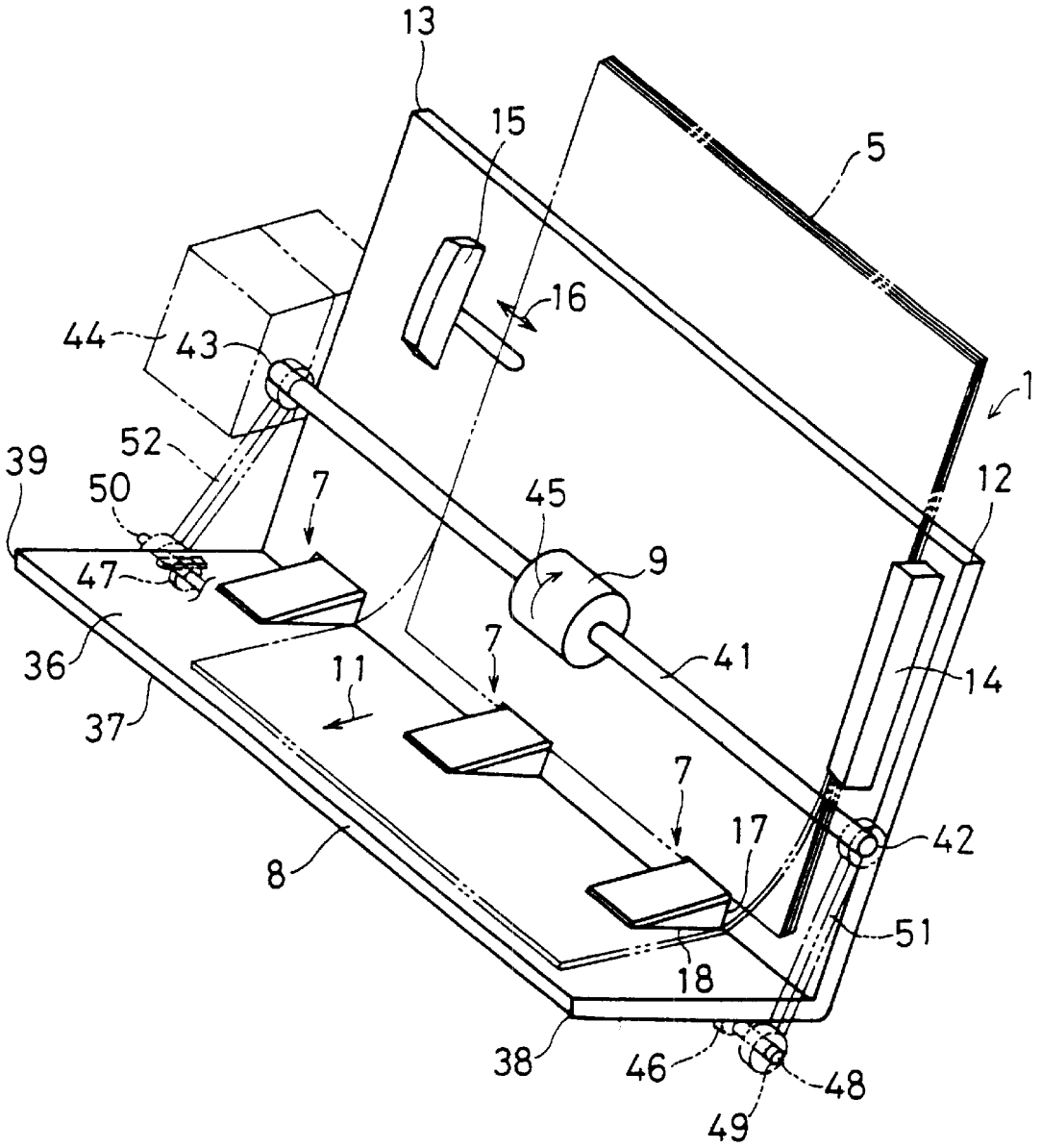
FIG. 3 is a perspective view showing in simplified form the construction of the paper sheet feeding apparatus 1 of FIG. 1.

FIG. 1 is a cross sectional view showing in simplified form the construction of a paper sheet feeding apparatus 1 according to one embodiment of the invention, FIG. 2 is a perspective view showing in simplified form the construction of a recording apparatus 2 equipped with the paper sheet feeding apparatus 1 shown in FIG. 1, and FIG. 3 is a perspective view showing in simplified form the construction of the paper sheet feeding apparatus 1 of FIG. 1. The paper sheet feeding apparatus 1 includes: a back plate 4 having a supporting face 3, arranged so as to slope down toward the downstream side in the paper sheet feeding direction; resilient supporting means 7, disposed near the lower part of the back plate 4, for resiliently supporting the lower edge 6 of recording paper sheets 5 resting on the back plate 4; a bottom plate 8, disposed downstream of the resilient supporting means 7 as viewed in the paper sheet feeding direction, for guiding the recording paper sheets 5; and a paper sheet feeding roller 9 for feeding out the uppermost one of the recording paper sheets by contacting an outside surface of the uppermost one of the recording paper sheets 5 held on the supporting face 3.

The back plate 4 is a flat plate made of a synthetic resin; near one edge 12 thereof, there is provided a first recording paper sheet guide piece 14 protruding from the supporting face 3 of the back plate 4 and extending substantially parallel to the side face of the one edge 12, while near the other edge 13 of the back plate 4, a second recording paper sheet guide piece 15 is disposed opposite the first recording paper sheet guide piece 14. The first recording paper sheet guide piece 14 is rigidly attached to the supporting face 3. The second recording paper sheet guide piece 15 is mounted slidably in the direction shown by arrow 16 so that its guide position can be changed according to the size of the recording paper sheets.

The resilient supporting means 7 is accommodated within a space defined by a first cut-out 17, which is formed in the downstream side of the back plate 4, and a second cut-out 18, which is formed in the upstream side of the bottom plate 8 continuously from the first cut-out 17. A support piece supporting shaft 40 whose axis 23 extends perpendicularly to the paper sheet feeding direction is mounted on the downstream portions of opposing edge faces which form part of the second cut-out 18 in the bottom plate 8 and which are opposite each other in the direction perpendicular to the paper sheet feeding direction.

The resilient supporting means 7 includes a rocking support piece 24 whose downstream end portion 21 is supported on the bottom plate 8 by means of the support piece supporting shaft 40 in such a manner as to be angularly displaceable about the axis 23 extending perpendicularly to the paper sheet feeding direction, and whose upstream end portion 22 is positioned rearwardly of the supporting face 3 of the back plate 4, and a spring 26 for applying an upwardly directed spring force to the upstream end portion 22 of the rocking support piece 24, and thereby pressing the upstream end portion 22 of the rocking support piece 24 against a holding portion 25 which is an upstream end face forming part of the first cut-out 17 in the back plate 4.

The rocking support piece 24 is made of a synthetic resin, and includes a receiving face 27 for receiving thereon the lower edge 6 of the recording paper sheets; with the upstream end port ion 22 pressed against the holding portion 25, the receiving face 27 of the rocking support piece 24 makes an angle of $\theta 1$ with the supporting face 3 of the back plate. The angle $\theta 1$ is preset by experimentally determining an angle suitable for feeding the recording paper sheets according to the dimensions, particularly, the range of thicknesses, of the recording paper sheets expected to be handled by the paper sheet feeding apparatus 1. One end 28 of the spring 26 supports an opposite face 32, opposite from the receiving face 27, at the upstream end portion 22 of the rocking support piece 24, while the other end 29 of the spring 26 is secured to a face 31 that faces the rocking support piece 24 and that forms part of a spring supporting member 30 disposed rearwardly of the bottom plate 8. In the present embodiment, three resilient supporting means 7 of identical structure are disposed spaced apart along a direction perpendicular to the paper sheet feeding direction.

The bottom plate 8 is a flat plate made of a synthetic resin, and includes a guide face 36 for guiding the recording paper sheets being transported downstream in the paper sheet feeding direction; the guide face 36 of the bottom plate 8 makes an angle of $\theta 2$ with the supporting face 3 of the back plate 4. The angle $\theta 1$ is greater than the angle $\theta 2$ which is an obtuse angle greater than 90 degrees; hence, $\theta 1 > \theta 2 > 90$ degrees.

The paper sheet feeding roller 9 is mounted on a roller rotating shaft 41 which is mounted in the paper sheet feeding apparatus 1 by means of arms 51 and 52 described below in such a manner as to be rotatable about an axis extending perpendicularly to the paper sheet feeding direction. An opposite end 43 of the roller rotating shaft 41 is connected to a drive source 44 such as a motor, and the rotational driving force of the drive source 44 is transmitted to the roller rotating shaft 41, causing the roller rotating shaft 41 and the paper sheet feeding roller 9 to rotate in the direction of arrow 45.

On a face 37 of the bottom plate 8 opposite from the guide face 36 thereof are mounted bearings 46 and 47, one at one end 38 of the opposite face 37 and the other at the other end 39 thereof. An arm supporting shaft 48 whose axis extends perpendicularly to the paper sheet feeding direction is inserted in the bearings 46 and 47, and one end of each of the arms 51 and 52 is attached to one end 49 or the other end 50 of the arm supporting shaft 48 in such a manner as to be angularly displaceable about the axis extending perpendicularly to the paper sheet feeding direction, while one end 42 and the other end 43 of the roller rotating shaft 41 are rotatably supported on the other ends of the arms 51 and 52, respectively.

The arms 51 and 52 are angularly displaceable about the axis of the arm supporting shaft 48 extending perpendicularly to the paper sheet feeding direction, in such a manner as to move toward the supporting face 3 of the back plate 4 by the force of gravity acting on the paper sheet feeding roller 9, roller rotating shaft 41, drive source 44, etc. With the angular displacement of the arms 51 and 52, the paper sheet feeding roller 9 is brought into contact with the uppermost one of the recording paper sheets placed on the supporting face 3. When the roller rotating shaft 41 is rotated by the drive source 44 in the direction of arrow 45 under the condition that the paper sheet feeding roller 9 contacts the uppermost one of the recording paper sheets placed on the supporting face 3, the paper sheet feeding roller 9 rotates with the roller rotating shaft 41 to feed the recording paper sheets.

The recording apparatus 2 equipped with the paper sheet feeding apparatus 1 includes a print head 61 for printing on the recording paper sheet at a position downstream of the bottom plate 8 of the paper sheet feeding apparatus 1 as viewed in the paper sheet feeding direction, and a platen 62 mounted below the print head and rotatable in the direction of arrow 67. The print head 61 is mounted on a guide shaft 63, which extends perpendicularly to the paper sheet feeding direction, in such a manner as to be movable in directions indicated by arrow 66; the print head 61 is moved along the guide shaft 63 by means of a timing belt 64 and, in accordance with print information, prints on the recording paper sheet 65 being passed between the print head 61 and the platen 62.

Figure 4:
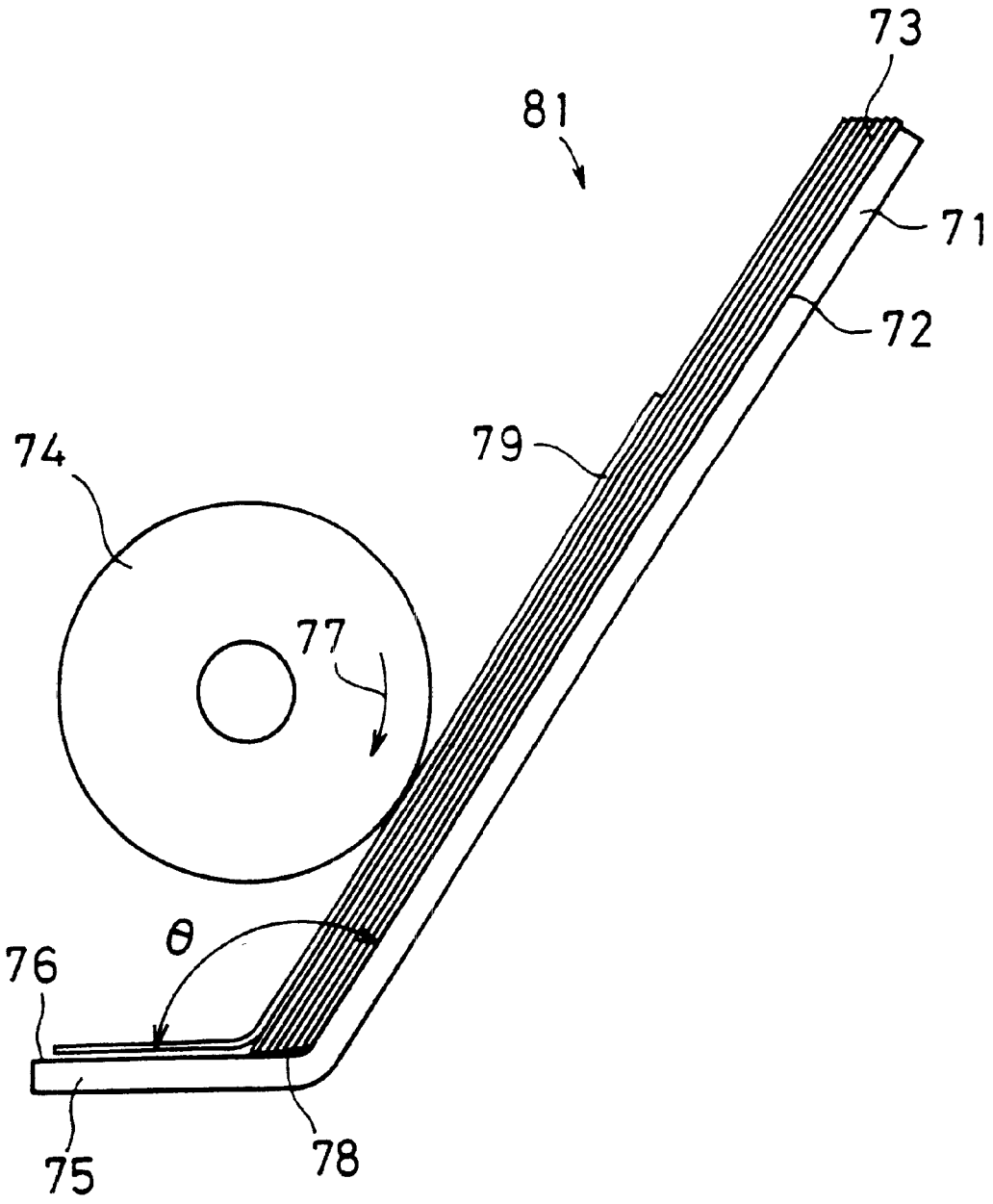
FIG. 4 is a diagram schematically showing how recording paper sheets 73 are separated and fed out by a paper sheet feeding apparatus 81 using an angular separation method.

FIG. 4 is a diagram schematically showing how recording paper sheets 73 are separated and fed out by a paper sheet feeding apparatus 81 using an angular separation method. The recording paper sheets 73 are placed on the supporting face 72 of the back plate 71, and the uppermost one 79 of the recording paper sheets is fed along the guide face 76 of the bottom plate 75 by means of a paper sheet feeding roller 74. The angular separation method separates and feeds the recording paper sheets in the following manner. For each of the recording paper sheets placed on the supporting face 72 of the back plate 71, the surface facing the paper sheet feeding roller 74 is referred to as the outside surface of the recording paper sheet, and the surface opposite to it as the inside surface. In order to feed out the sheet, the following relation must be satisfied:

$$A>B+C \tag{1}$$

wherein A is a friction force between the paper sheet feeding roller 74 and the outside surface of the uppermost paper sheet 79 generated in rotating the paper sheet feeding roller 74 in the direction of arrow 77, B is a friction force between the inside surface of the uppermost paper sheet 79 and the outside surface of a second uppermost paper sheet, and C is a force that resists further advancement of the recording paper sheets when the lower edge 78 of the recording paper sheets being fed out of the supporting face 72 of the back plate 71 by the rotating paper sheet feeding roller 74 hits the guide face 76 of the bottom plate 75 (this force is hereinafter called the resisting force) To prevent a plurality of recording sheets from being fed out simultaneously, the following relation must be satisfied:

$$B<C+D \tag{2}$$

wherein D is a friction force between the inside surface of the second uppermost paper sheet and the outside surface of a third uppermost paper sheet.

The friction forces between the paper sheet feeding roller 74 and the recording paper sheets and between the recording paper sheets are affected by the thickness of recording paper sheet and environmental conditions, especially, humidity. The resisting force is determined by the angle θ that the guide face 76 of the bottom plate 75 makes with the supporting face 72 of the back plate 71. The greater the angle θ, the smaller the resisting force, and the smaller the angle θ, the larger the resisting force. For example, in the case of thick recording paper sheets such as a post card, if the angle θ is small, the post card cannot be transported because the resisting force is large. Conversely, in the case of thin recording paper sheets, if the angle θ is large, a plurality of recording paper sheets will be fed simultaneously because the resisting force is too small. Therefore, the angle θ that suits the range of thicknesses of recording paper sheets expected to be handled by the paper sheet feeding apparatus must be determined in advance by experiment.

When the angle θ between the guide face 76 of the bottom plate 75 and the supporting face 72 of the back plate 71 is set within the suitable range determined by experiment, and when the relations between the resisting force and friction forces, i.e., $$A>B+C \text{ and } B<C+D$$

are satisfied, the recording paper sheets are fed out one by one.

Figure 5:
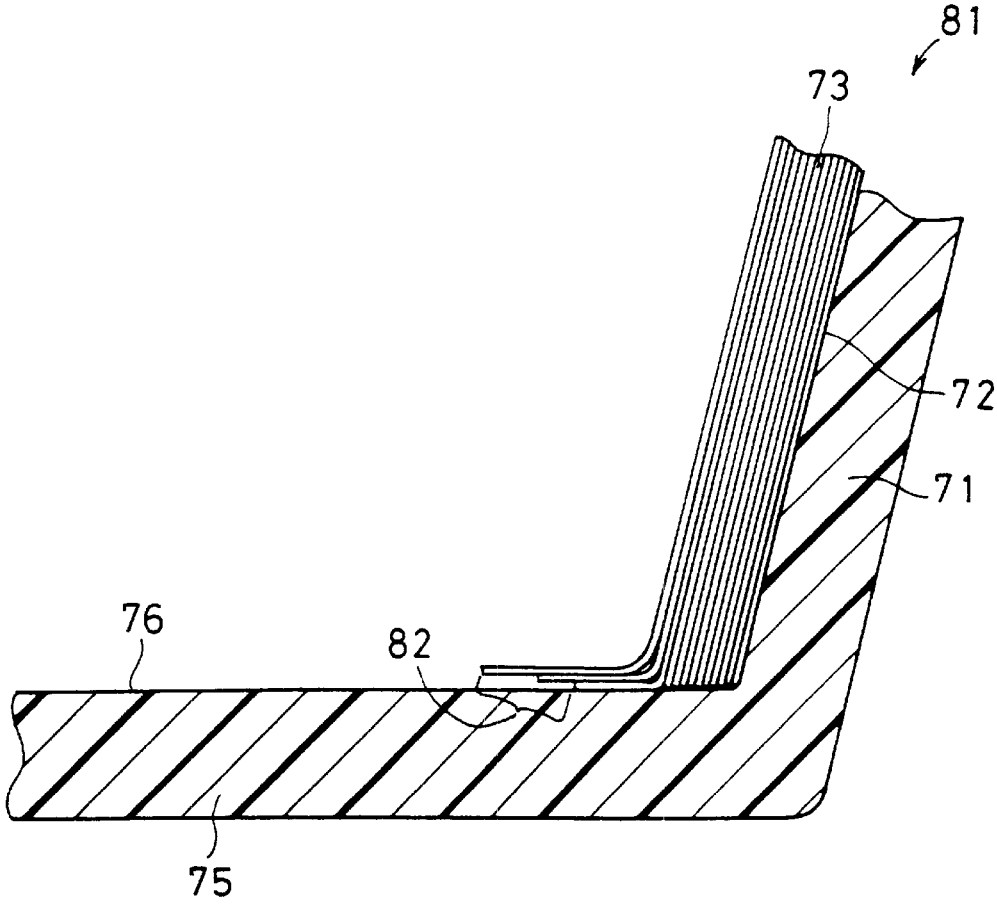
FIG. 5 is a diagram showing a situation in which, of the recording paper sheets 73 loaded into the paper sheet feeding apparatus 81, a plurality of upper paper sheets 82 are advanced beyond the boundary between back plate 71 and bottom plate 75 and are riding over the guide face 76 of the bottom plate 75.

FIG. 5 is a diagram showing a situation in which, of the recording paper sheets 73 loaded into the paper sheet feeding apparatus 81, a plurality of upper sheets 82 are advanced beyond the boundary between the back plate 71 and the bottom plate 75 and are riding over the guide face 76 of the bottom plate 75. If the user of the paper sheet feeding apparatus 81 inserts the recording paper sheets 73 into the paper sheet feeding apparatus 81 attended with an impact force, a plurality of upper sheets 82 of the loaded recording paper sheets 73 may cross the boundary between the back plate 71 and the bottom plate 75 and ride over the guide face 76 of the bottom plate 75. In this case, since the lower edges of the plurality of sheets 82 riding over the guide face 76 of the bottom plate 75 are no longer in contact with the guide face 76, but are pointing downstream in the paper sheet feeding direction, the resisting force of the guide face 76 does not act on them. As a result, when the separation and feed of the recording paper sheets 73 is started by rotating the paper sheet feeding roller 74, the plurality of sheets 82 whose lower edges are riding over the guide face 76 of the bottom plate 75 are fed out simultaneously by the paper sheet feeding roller 74.

Figure 6:
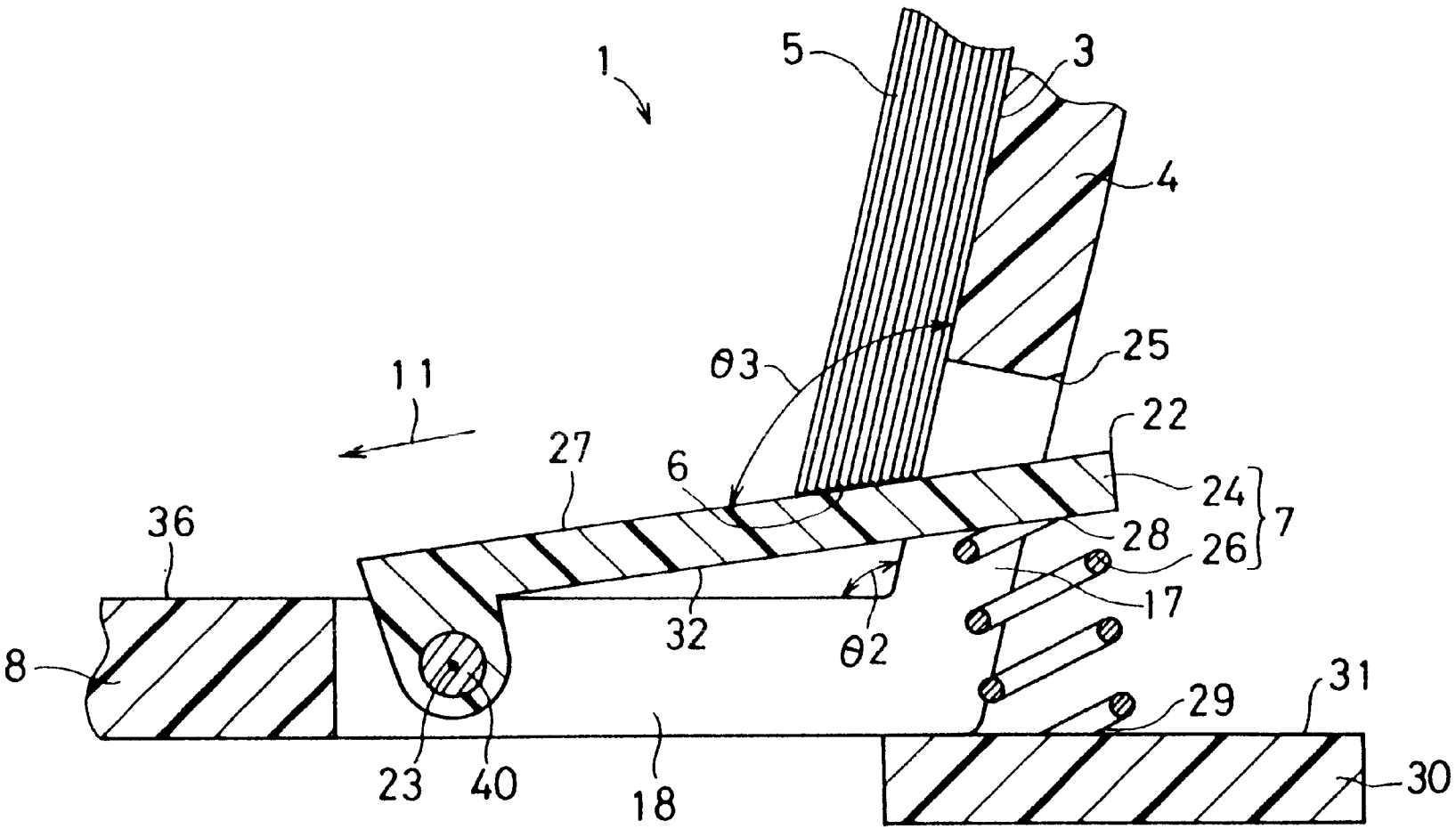
FIG. 6 is a cross sectional view showing a situation in which recording paper sheets 5 are inserted in the paper sheet feeding apparatus 1 attended with an impact force.

FIG. 6 is a cross sectional view showing a situation in which the recording paper sheets 5 are inserted in the paper sheet feeding apparatus 1 attended with an impact force. When the user of the paper sheet feeding apparatus 1 inserts the recording paper sheets 5 into the paper sheet feeding apparatus 1 attended with an impact force, the receiving face 27 of the rocking support piece 24 holds the inserted recording paper sheets 5 by receiving thereon the lower edge 6 of the inserted recording paper sheets 5. At this time, the spring 26 supporting the upstream end portion 22 of the rocking support piece 24 is compressed according to the impact force with which the recording paper sheets 5 are inserted, and the rocking support piece 24 is angularly displaced about the axis 23 extending perpendicularly to the paper sheet feeding direction and thus absorbs the impact force when the recording paper sheets 5 are inserted in the paper sheet feeding apparatus 1. This prevents the lower edge 6 of the recording paper sheets inserted in the paper sheet feeding apparatus 1 from riding over the receiving face 27 of the rocking support piece 24. When the rocking support piece 24 is angularly displaced about the axis 23 extending perpendicularly to the paper sheet feeding direction, the angle θ3 that the receiving face 27 of the rocking support piece 24 makes with the supporting face 3 of the back plate 4 becomes smaller than the angle θ1 that the receiving face 27 of the rocking support piece 24 makes with the supporting face 3 of the back plate 4 when the upstream end portion 22 of the rocking support piece 24 is in contact with the holding portion 25 before the recording paper sheets 5 are inserted. Accordingly, when the recording paper sheets 5 are inserted into the paper sheet feeding apparatus 1, and the rocking support piece 24 is displaced angularly, the receiving face 27 of the rocking support piece 24 provides a greater paper feed resisting force, thus preventing the lower edge 6 of the recording paper sheets 5 inserted in the paper sheet feeding apparatus 1 from riding over the receiving face 27 of the rocking support piece 24.

When the impact force generated in inserting the recording paper sheets 5 into the paper sheet feeding apparatus 1 is absorbed, the compressed spring 26 supporting the upstream end portion 22 of the rocking support piece 24 is restored to its original shape. As the spring 26 is restored to its original shape, the rocking support piece 24 with the stack of recording paper sheets 5 held stationary thereon moves back to the position where the receiving face 27 contacts the holding portion 25 at the upstream end portion 22 of the rocking support piece 24. The angle θ1 that the receiving face 27 of the rocking support piece 24 makes with the supporting face 3 of the back plate 4 under the condition that the upstream end portion 22 of the rocking support piece 24 is held in contact with the holding portion 25, is set equal to the angle experimentally determined in advance as suitable for feeding the recording paper sheets one by one. Accordingly, when the recording paper sheets separation and feed operation is started, since the rocking support piece 24 is held in a position suitable for paper sheets separation and feeding, the recording paper sheets can be securely fed out one sheet at a time.

Figure 7:
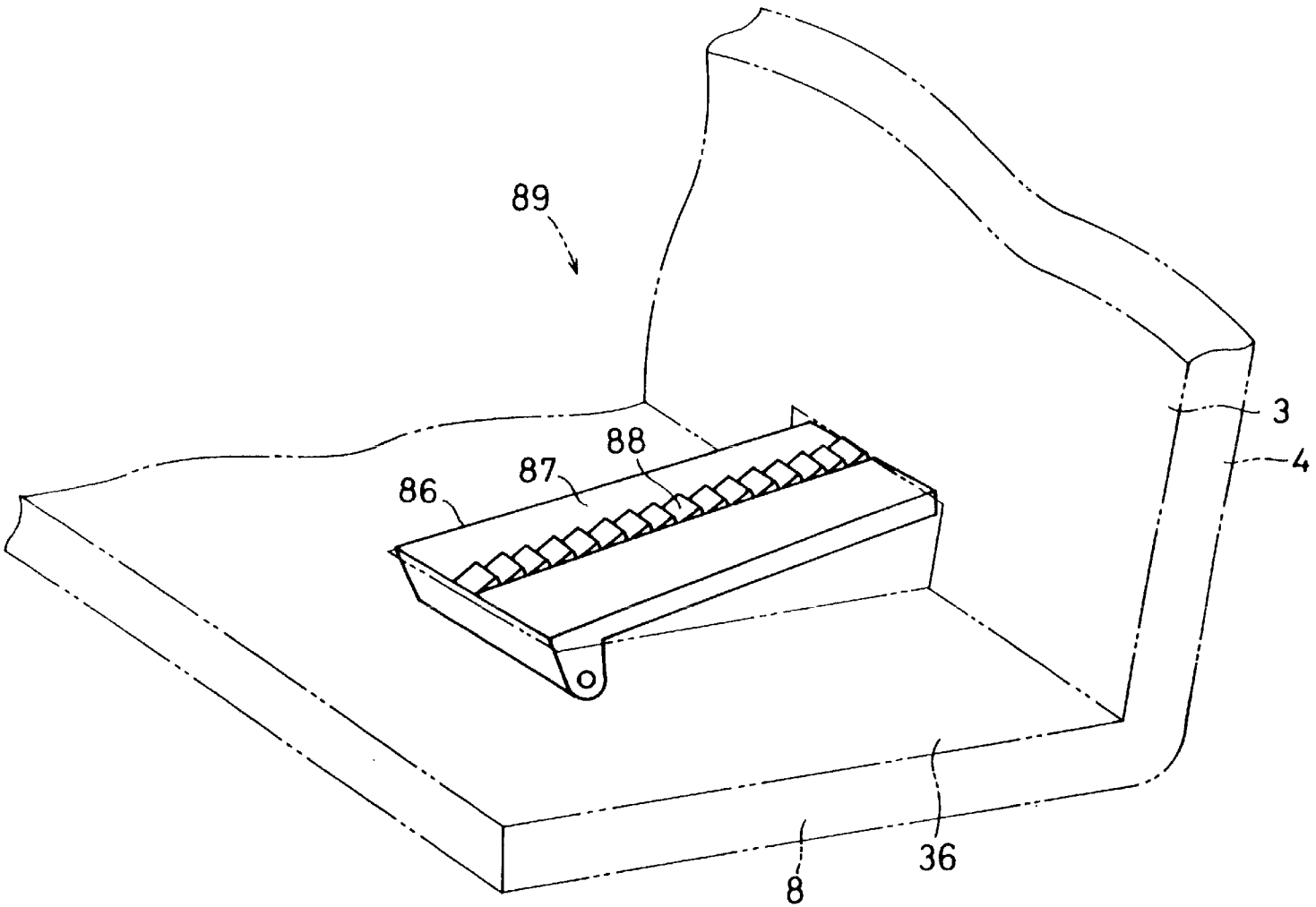
FIG. 7 is a perspective view showing a second embodiment of the invention in which a serrated portion 88 is formed on the receiving face 87 of a rocking support piece 86.
Figure 8:
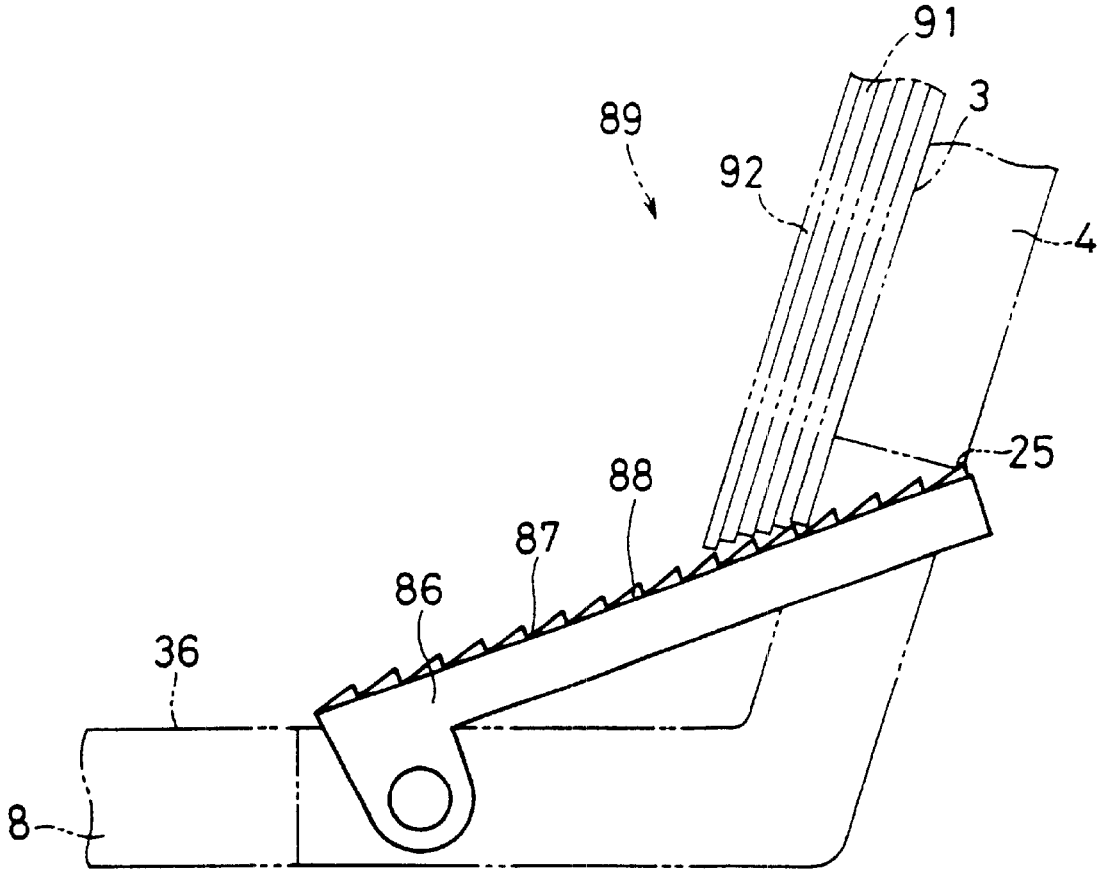
FIG. 8 is a side view of FIG. 7.
Figure 9:
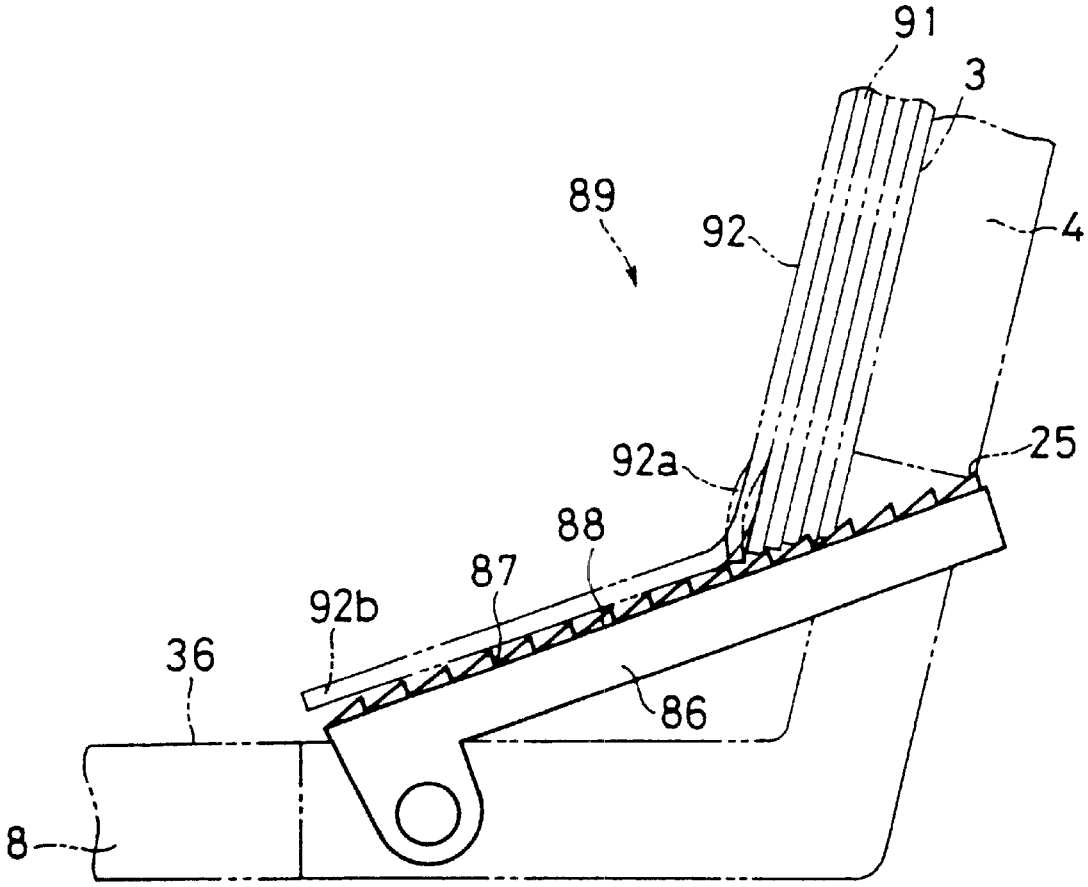
FIG. 9 is a diagram showing how a recording paper sheet is fed in FIG. 8.

FIG. 7 is a perspective view showing a second embodiment of the invention in which a serrated portion 88 is formed on the receiving face 87 of a rocking support piece 86, FIG. 8 is a side view of FIG. 7, and FIG. 9 is a diagram showing how recording paper sheets are fed in FIG. 8. In this embodiment, the serrations 88 resembling the teeth of a saw are formed one behind another in the paper sheet feeding direction along the center of the receiving face 87 of the rocking support piece 86, the center being the center of the receiving face 87 as seen in a direction perpendicular to the paper sheet feeding direction. Even when recording paper sheets 91 are inserted into the paper sheet feeding apparatus 89 attended with an impact force, the serrated portion 88 receives the lower edge of the inserted recording paper sheets 91 with the serrations 88 acting to prevent the lower edge of the recording paper sheets 91 from slipping and riding over the receiving face 87 of the rocking support piece 86. When feeding the uppermost paper sheet 92 of the recording paper sheets, the advancement of the uppermost paper sheet 92 is resisted by one of the serrations 88 formed on the receiving face 87, temporarily causing the lower edge 92*a* of the uppermost paper sheet 92 to curve, but when the force acting to advance the recording paper sheets exceeds the resisting force, the uppermost sheet 92 is fed downstream in the paper sheet feeding direction with its lower edge 92*b* riding over the sawtooth-like serrations 88. With the provision of the serrations 88 on the receiving face 87 of the rocking support piece 86, since the lower edge of the recording paper sheets 91 inserted into the paper sheet feeding apparatus 89 is securely received by the serrations 88 on the receiving face 87, the function of reliably feeding the recording paper sheets one sheet at a time can be further enhanced.

In the invention, even when the rocking support piece does not have serrations on its receiving face, the structure can effectively prevent the lower edge of the recording paper sheets from riding over the receiving face of the rocking support piece. Since there is no need to provide all the necessary resisting force by using only the serrations formed on the receiving face of the rocking support piece, the height of the serrations protruding from the receiving face can reduced to such a height that does not damage the lower edge of the recording paper sheets; in that case also, the resisting force of the receiving face can be increased because of the nonslip function that the serrated portion has.

As described above, in the first and second embodiments of the invention, the rocking support piece is supported by a spring, but alternatively, the rocking support piece may be supported using a rubber or other shock absorbing member. Further, each embodiment has been described as having three resilient supporting means, but the number of resilient supporting means need not necessarily be limited to three; for example, two or less or four or more resilient supporting means may be provided. Furthermore, though the serrations provided on the receiving face of the rocking support piece have been described as being formed one behind another in the recording paper sheet feeding direction along the center of the receiving face of the rocking support piece (the center here means the center of the receiving face as seen in a direction perpendicular to the paper sheet feeding direction), the serrations may be formed locally or over the entire area of the receiving face of the rocking support piece. The serrations provided on the receiving face of the rocking support piece have been described as being formed in the shape of saw teeth, but the serrations need not be limited to this particular shape, but other suitable shape may be employed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A paper sheet feeding apparatus comprising:

a back plate having a supporting face, arranged so as to slope down toward a downstream side in a paper sheet feeding direction;

resilient supporting means, disposed near a lower part of the back plate, for resiliently supporting a lower edge of a stack of recording paper sheets resting on the back plate;

a portion of the resilient supporting means located in a cut-out in the back plate and extending beyond an outer surface of the back plate, the outer surface being opposite to the supporting face, a bottom plate, disposed downstream of the resilient supporting means in the paper sheet feeding direction, for guiding the recording paper sheets; and a paper sheet feeding roller for feeding out an uppermost sheet of the stack of recording paper sheets by contacting an uppermost recording paper sheet of the stack of recording paper sheets held on the supporting face.

2. The paper sheet feeding apparatus of claim 1, wherein the resilient supporting means includes:

a rocking support piece whose downstream end portion in the paper sheet feeding direction is supported so as to be angularly displaceable about an axis extending perpendicularly to the paper sheet feeding direction, and whose upstream end portion as viewed in the paper sheet feeding direction is positioned rearwardly of the supporting face of the back plate, and a spring for applying an upwardly directed spring force to the upstream end portion of the rocking support piece, and thereby pressing the upstream end portion of the rocking support piece against a predetermined position with a stack of recording paper sheets held in a stationary condition, and the following relation is satisfied:

$$\theta 1 > \theta 2,$$

wherein θ1 represents an angle which a receiving face of the rocking support piece makes with the supporting face of the back plate when the stack of recording paper sheets is held in the stationary condition, and θ2 represents an angle which the supporting face of the back plate makes with a guide face of the bottom plate.

3. The paper sheet feeding apparatus of claim 2, wherein a plurality of rocking support pieces are disposed spaced apart in a direction perpendicular to the paper sheet feeding direction.

4. A paper sheet feeding apparatus comprising:

a back plate having a supporting face, arranged so as to slope down toward a downstream side in a paper sheet feeding direction;

resilient supporting means, disposed near a lower part of the back plate, for resiliently supporting a lower edge of a stack of recording paper sheets resting on the back plate;

a bottom plate, disposed downstream of the resilient supporting means in the paper sheet feeding direction, for guiding the recording paper sheets; and a paper sheet feeding roller for feeding out an uppermost sheet of the stack of recording paper sheets by contacting an uppermost recording paper sheet of the stack of recording paper sheets held on the supporting face;

the resilient supporting means includes:

the rocking support piece whose downstream end portion in the paper sheet feeding direction is supported so as to be angularly displaceable about an axis extending perpendicularly to the paper sheet feeding direction, and whose upstream end portion as viewed in the paper sheet feeding direction is positioned rearwardly of the supporting face of the back plate, and a spring for applying an upwardly directed spring force to the upstream end portion of the rocking support piece, and thereby pressing the upstream end portion of the rocking support piece against a predetermined position with a stack of recording paper sheets held in a stationary condition, and the following relation is satisfied:

$$\theta 1 > \theta 2,$$

wherein θ1 represents an angle which a receiving face of the rocking support piece makes with the supporting face of the back plate when the stack of recording paper sheets is held in the stationary condition, and θ2 represents an angle which the supporting face of the back plate makes with a guide face of the bottom plate;

wherein a serrated portion with serrations arranged in the paper sheet feeding direction is formed on the receiving face of the rocking support piece.

5. A recording apparatus comprising:

a back plate having a supporting face, arranged so as to slope down toward a downstream side in a paper sheet feeding direction;

resilient supporting means, disposed near a lower part of the back plate, for resiliently supporting a lower edge of a stack of recording paper sheets resting on the back plate;

a portion of the resilient supporting means located in a cut-out in the back plate and extending beyond an outer surface of the back plate, the outer surface being opposite to the supporting face;

a bottom plate, disposed downstream of the resilient supporting means in the paper sheet feeding direction, for guiding the recording paper sheets; and a paper sheet feeding roller for feeding out an uppermost sheet of the stack of recording paper sheets by contacting an uppermost recording paper sheet of the stack of recording paper sheets held on the supporting face, and a print head for printing on a recording paper sheet at a position downstream of the bottom plate of the paper sheet feeding apparatus as viewed in the paper sheet feeding direction.

6. A recording apparatus comprising:

the paper sheet feeding apparatus of claim 5, wherein the resilient supporting means includes:

a rocking support piece whose downstream end portion in the paper sheet feeding direction is supported so as to be angularly displaceable about an axis extending perpendicularly to the paper sheet feeding direction, and whose upstream end portion as viewed in the paper sheet feeding direction is positioned rearwardly of the supporting face of the back plate;

a spring for applying an upwardly directed spring force to the upstream end portion of the rocking support piece, and thereby pressing the upstream end portion of the rocking support piece against a predetermined position with a stack of recording paper sheets held in a stationary condition, and the following relation is satisfied:

$$\theta 1 > \theta 2,$$

wherein θ1 represents an angle which a receiving face of the rocking support piece makes with the supporting face of the back plate when the stack of recording paper sheets is held in the stationary condition, and θ2 represents an angle which the supporting face of the back plate makes with a guide face of the bottom plate, and a print head for printing on a recording paper sheet at a position downstream of the bottom plate of the paper sheet feeding apparatus as viewed in the paper sheet feeding direction.

7. A recording apparatus comprising:

the paper sheet for feeding apparatus of claim 6, wherein the resilient supporting means includes:

a rocking support piece whose downstream end portion in the paper sheet feeding direction is supported so as to be angularly displaceable about an axis extending perpendicularly to the paper sheet feeding direction, and whose upstream end portion as viewed in the paper sheet feeding direction is positioned rearwardly of the supporting face of the back plate;

a spring for applying an upwardly directed spring force to the upstream end portion of the rocking support piece, and thereby pressing the upstream end portion of the rocking support piece against a predetermined position with a stack of recording paper sheets held in a stationary condition, and the following relation is satisfied:

$$\theta 1 > \theta 2,$$

wherein θ1 represents an angle which a receiving face of the rocking support piece makes with the supporting face of the back plate when the stack of recording paper sheets is held in the stationary condition, and $O_2$ represents an angle which the supporting face of the back plate makes with a guide face of the bottom plate, wherein a plurality of rocking support pieces are disposed spaced apart in a direction perpendicular to the paper sheet feeding direction; and a print head for printing on a recording paper sheet at a position downstream of the bottom plate of the paper sheet feeding apparatus as viewed in the paper sheet feeding direction.

8. A recording apparatus comprising:

a back plate having a supporting face, arranged so as to slope down toward a downstream side in a paper sheet feeding direction;

resilient supporting means, disposed near a lower part of the back plate, for resiliently supporting a lower edge of a stack of recording paper sheets resting on the back plate;

a bottom plate, disposed downstream of the resilient supporting means in the paper sheet feeding direction, for guiding the recording paper sheets; and a paper sheet feeding roller for feeding out an uppermost sheet of the stack of recording paper sheets by contacting an uppermost recording paper sheet of the stack of recording paper sheets held on the supporting face, and a print head for printing on a recording paper sheet at a position downstream of the bottom plate of the paper sheet feeding apparatus as viewed in the paper sheet feeding direction;

wherein the resilient supporting means includes:

a rocking support piece whose downstream end portion in the paper sheet feeding direction is supported so as to be angularly displaceable about an axis extending perpendicularly to the paper sheet feeding direction, and whose upstream end portion as viewed in the paper sheet feeding direction is positioned rearwardly of the supporting face of the back plate;

a spring for applying an upwardly directed spring force to the upstream end portion of the rocking support piece, and thereby pressing the upstream end portion of the rocking support piece against a predetermined position with a stack of recording paper sheets held in a stationary condition, and the following relation is satisfied:

$$f1 > \theta 2,$$

wherein f1 represents an angle which a receiving face of the rocking support piece makes with the supporting face of the back plate when the stack of recording paper sheets is held in the stationary condition, and θ2 represents an angle which the supporting face of the back plate makes with a guide face of the bottom plate;

wherein a serrated portion with serrations arranged in the paper sheet feeding direction is formed on the receiving face of the rocking support piece; and a print head for printing on a recording paper sheet at a position downstream of the bottom plate of the paper sheet feeding apparatus as viewed in the paper sheet feeding direction.

* * * * *